United States Patent [19]

Coussan

[11] Patent Number: 4,480,686

[45] Date of Patent: Nov. 6, 1984

[54] GAS LIFT MANDREL

[75] Inventor: Sidney G. Coussan, Lafayette, La.

[73] Assignee: Daniel Industries, Inc., Houston, Tex.

[21] Appl. No.: 457,115

[22] Filed: Jan. 10, 1983

[51] Int. Cl.[3] ..... E21B 23/03

[52] U.S. Cl. ..... 166/117.5

[58] Field of Search ..... 166/117.5, 322, 242, 166/382, 386

[56] References Cited

U.S. PATENT DOCUMENTS

| | | | |
|---|---|---|---|
| 2,824,525 | 2/1958 | McGowen | 166/117.5 X |
| 3,994,339 | 11/1976 | Goode et al. | 166/117.5 |
| 4,106,563 | 8/1978 | Gatlin et al. | 166/117.5 |
| 4,197,909 | 4/1980 | Terral | 166/117.5 |
| 4,201,265 | 5/1980 | Thomason et al. | 166/117.5 |

*Primary Examiner*—Stephen J. Novosad

*Assistant Examiner*—Michael Starinsky

*Attorney, Agent, or Firm*—Gunn, Lee & Jackson

[57] ABSTRACT

A gas lift mandrel is provided for installation in a string of production tubing extending into a well casing for gas energized production of petroleum products. The mandrel incorporates a tubular body having offset extremities for connection to tubing sections and defining a well aperture in its side wall. An inner tubular sleeve is located within the tubular body and defines an elongated opening within which is received a valve receptacle and valve guard in coextensive relation. The valve receptacle incorporates an external weld boss which is located within the weld aperture of the body and connected to the body by welding. The inner sleeve varies in thickness from a maximum thickness on the side of the aperture to a minimum thickness on the side opposite the weld aperture.

7 Claims, 13 Drawing Figures

FIG. 7
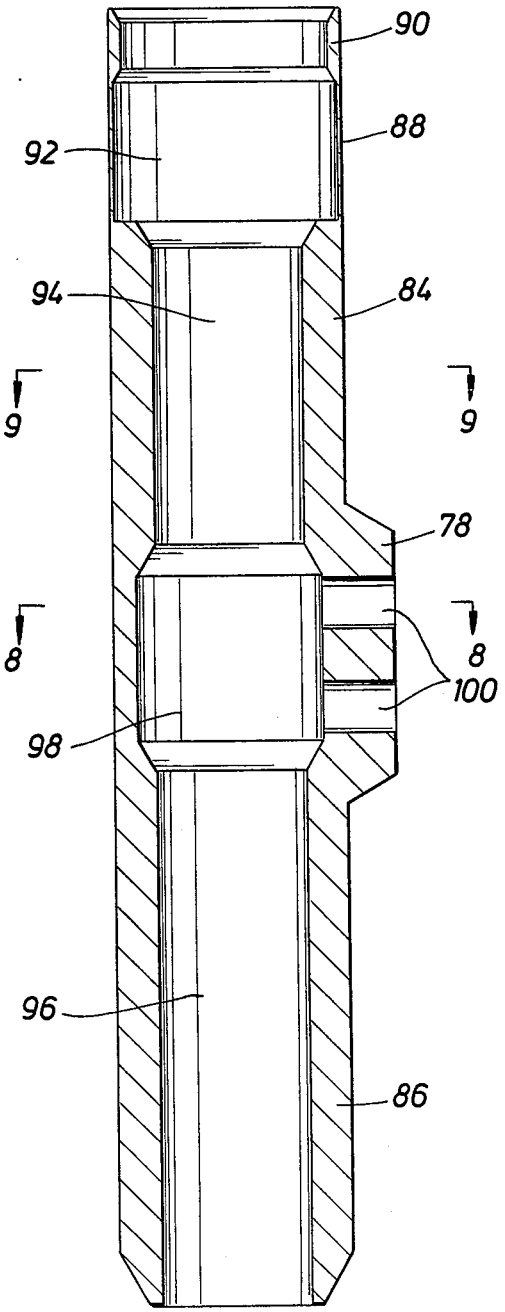
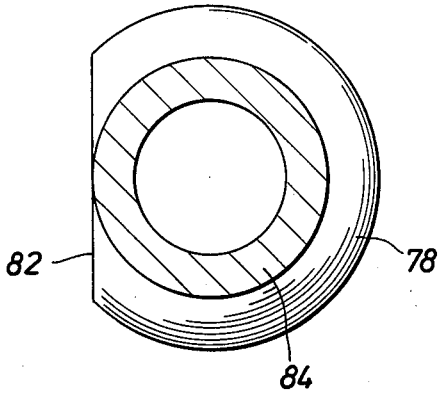
FIG. 9
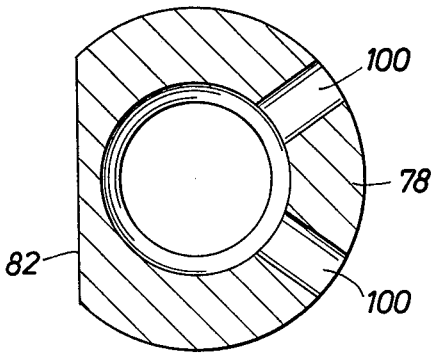
FIG. 8

FIG. 11
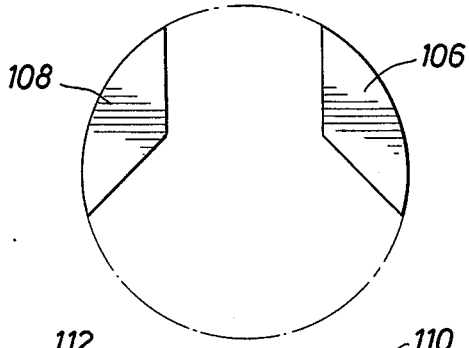
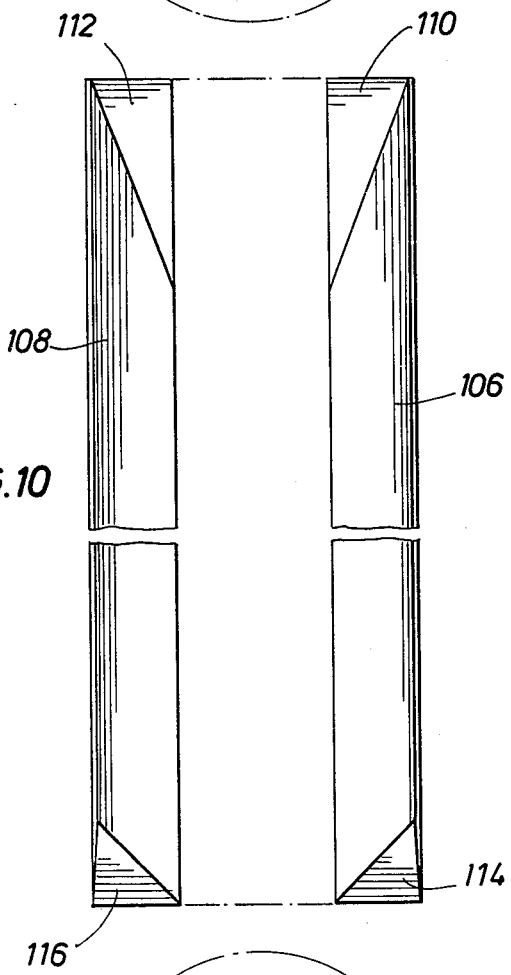
FIG. 10
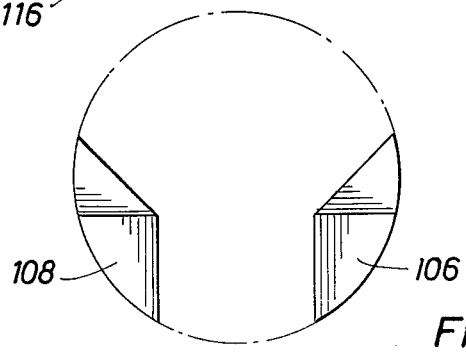
FIG. 12
FIG. 13
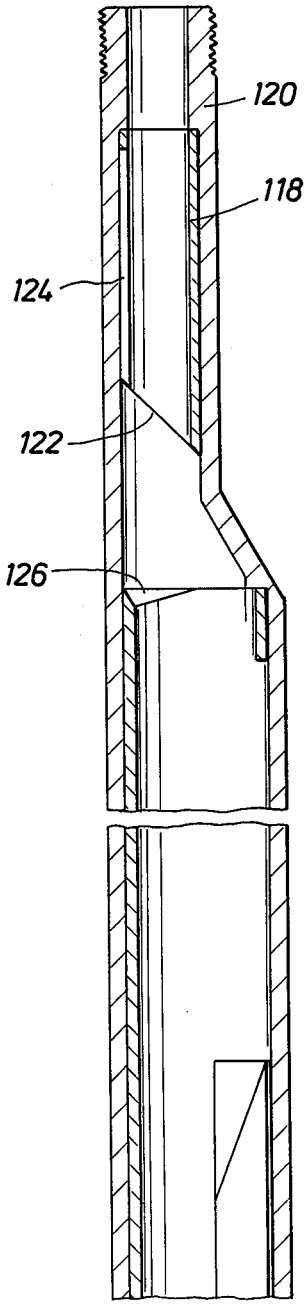

GAS LIFT MANDREL

FIELD OF THE INVENTION

This invention relates generally to gas lift valves for gas energized production of liquid petroleum products and more specifically concerns a gas lift mandrel structure having an inner sleeve for additional strengthening capability and being designed for accommodation of retrievable gas lift valves.

BACKGROUND OF THE INVENTION

In the production of oil bearing formations, well bores are drilled from the surface of the earth to the level of subsurface production formations. The wells are completed by extending well casing into the well bore and cementing the casing in place. At the level of the production formation the well casing is typically perforated to establish communication of the well casing and the production formation. Production tubing is then extended through the casing and is sealed with respect to the casing by one or more packers which ensure that the upward flow of production fluid is restricted solely to the production tubing.

In most cases production formations, especially deep formations, are under gas pressure. The gas within the formation serves as a driving medium to force liquid constituents of the production fluid into the well casing and upwardly through the production tubing to the surface. When the wells are deep or the formation contains sufficient formation pressure for gas induced production, the diameter of the well casing at the production formation can be fairly small. For example, many wells have been completed with well casing having an internal diameter in the order of six inches. This small diameter well casing is permitted when the formation is under gas driving pressure because it is not necessary to introduce pumps, gas lift valves or other production apparatus into the casing in order to achieve production.

After production of petroleum products from a reservoir over a long period of time, typically the gas pressure of the formation becomes depleted sufficiently that efficient production can no longer be accomplished by means of in situ pressurized gas. It is well known that far less than half of the crude oil in an oil-bearing subsurface formation has typically been produced at the time formation pressure is depleted. Since large quantities of crude oil remain in the formation, obviously it is desirable to provide alternative means for accomplishing oil production. One suitable means for oil production is the introduction of gas into well casing and controlled introduction of gas into the production tubing of the well in order that oil and other liquid constituents standing in the tubing string can be lifted to the surface for production. Gas lift production of liquid from wells has been quite successful over the years in continuing production of oil from wells which may be otherwise substantially nonproduceable. In the gas lift method of oil production, a number of gas lift valves are located in spaced relation along the length of the tubing string. These valves are pressure responsive and function automatically to introduce gas from the casing into the tubing string as necessary to induce upwardly flowing oil to continue flowing upwardly until it reaches the surface production equipment.

Gas lift mechanisms take two general forms, i.e., fixed gas lift valves which are secured within in mandrels connected at spaced locations along the length of a tubing string and retrievable gas lift valves which are capable of being inserted into and removed from the various spaced mandrels of the gas lift valve system. Since gas lift valves typically operate in a fluid handling environment wherein the fluid being handled is of corrosive and erosive nature and wherein the fluid also typically contains debris such as sand, pipe scale, etc., gas lift valves can become worn or fouled within a reasonably short period of time. In cases wherein gas lift valves are fixed within gas lift mandrels, it is of course necessary to remove the tubing string from the well when one or more gas lift valves is in need of servicing. When the tubing string is so removed, the valves are repaired or replaced and the tubing string is reinstalled into the well. Obviously, the cost of such servicing procedures is extensive and significantly affects the efficiency of production to a substantial degree. In the case of gas lift valve systems incorporating valves that are insertable and retrievable relative to the mandrels, servicing procedures can be accomplished by the use of simple and low cost servicing equipment such as wire line servicing equipment. Valves may be removed for servicing and replaced with new or overhauled valves within a reasonably short period of time with the tubing remaining in place during such servicing procedure. The well is serviced quickly and inexpensively and is placed back into production service much more quickly than is the typical case with fixed gas lift valves. In the case of fixed gas lift valves, obviously the servicing equipment that is utilized must be capable of lifting the tubing string from the well and replacing it after new or overhauled mandrels have been installed. There is no need for heavy duty tubing pulling systems when replaceable valves are utilized. The cost for servicing equipment and labor is minimized when servicing gas lift systems with retrievable valves.

From an inventory standpoint, utilization of fixed valves typically requires an inventory of many more gas lift mandrels in order to accomplish typical servicing procedures. In the case of replaceable valves, the mandrels and the tubing string remain in place within the well and servicing operation is conducted simply by removal and replacement of only the gas lift valves. The inventory requirements, therefore, for replaceable valve type gas lift systems is typically much lower.

One of the disadvantages of retrievable-type gas lift valve systems is that the valves must typically be of restricted size in order to accomplish production of oil from small diameter well casings. As stated above, many thousands of wells have been drilled and completed through the use of small diameter casing. Many of these wells have been shut in due to depletion of reservoir gas. In many cases, the wells have not been placed in gas lift production simply because of the small diameter casing will only permit installation of gas lift systems with valves of restricted size which will not permit adequate flow for efficient well production. For example, in well casing having an internal diameter of six inches, when retrievable gas lift valves are employed, the gas lift valves will typically have an internal flow passage restricted to a diameter of one inch. The reason for this retriction is the requirement that the gas lift mandrels of the system have straight through passages of sufficient diameter to permit the valves of lower mandrels to be passed therethrough during installation and removal of the valves. The mandrel bodies must be constructed with a wall structure of sufficient thickness to withstand designed maximum casing pressures for the purpose of safety and to provide sufficient tensile strength for efficient support of the tubing string and to withstand the tensile loads that are typically employed during installation and removal of the production tubing. Obviously, from the standpoint of production efficiency, it is desirable to employ gas lift valves having an internal diameter larger than one inch for production of petroleum products from wells having well casing with an internal diameter no greater than six inches. Larger gas lift valves of this nature would obviously permit much more efficient production of oil and other liquid production constituents since much more gas can be introduced into the tubing string at a given casing pressure, thus enhancing the liquid lifting capability of the upwardly flowing gas in the tubing.

SUMMARY OF THE INVENTION

It is therefore a primary feature of the present invention to provide a novel gas lift valve mandrel which facilitates utilization of large gas lift valves, such as one-and-one-half-inch valves for example, within small diameter well casing.

It is also a feature of this invention to provide a novel gas lift valve mandrel having the pressure-containing strength thereof enhanced through utilization of a separate internal strengthening sleeve.

It is an even further feature of this invention to provide a novel gas lift valve mandrel which incorporates a valve guard and valve receptacle for orienting and retaining a gas lift valve in interlocked relation within the mandrel.

Among the several objects of this invention is contemplated the provision of a novel gas lift valve mandrel incorporating an outer body section and an inner sleeve member which are welded into fixed assembly simultaneously with welding of end swage members onto the valve body.

It is also a feature of this invention to provide a novel gas lift valve mandrel which may incorporate an orienting sleeve as desired for the purpose of orienting a gas lift valve for insertion into an adjacent valve receptacle.

Briefly, a gas lift mandrel according to the present invention incorporates an outer tubular body having the end portions thereof prepared for welded attachment to upper and lower swage members which form the upper and lower extremities of the mandrel. The swage members are prepared such as by threading for connection of the mandrel to adjacent upper and lower sections of production tubing. The swage members are also formed to define an offset ecentric extremity having a dimension conforming to the dimension of the tubular body. The ecentric portions of the swage members are prepared to receive weld metal for attachment of the swage members to the body. The ecentric portions of the swage members are also formed internally to define annular receptacles which receive the extremities of an inner strengthening tube extending beyond each extremity of the tubular body. The inner strengthening tube is fixed relative to the tubular body by the weld which attaches the swage members to the body.

The tubular body is also formed to define a small weld receptacle in the side wall thereof within which is received a weld connection boss member extending from the intermediate portion of a gas lift receptacle element which is positioned within the tubular body. A valve guard is positioned in coextensive relation with the receptacle member and both the receptacle member and the valve guard are positioned within an elongated slot or opening that is formed in the side wall of the inner strengthening tube. The guard member functions to orient a gas lift valve as it is inserted into the receptacle provided therefor.

The inner strengthening tubular sleeve is formed with a wall thickness which varies from a thick portion at a side of the weld aperture of a tubular member and a thin portion which is located at the side opposite the weld aperture. The mandrel assembly may also incorporate an internal orienting sleeve for the purpose of properly orienting a gas lift valve prior to insertion of the valve into the valve receptacle of the mandrel.

Other and further objects and advantages of the present invention will become apparent from a consideration of the following drawings and description.

BRIEF DESCRIPTION OF THE DRAWINGS

FIG. 7 is a sectional view of the valve receptacle portion of the mandrel assembly of FIG. 1.

FIG. 8 is a transverse sectional view of the receptacle taken along line 8—8 of FIG. 7.

FIG. 9 is a transverse sectional view of the receptacle taken along line 9—9 of FIG. 7.

FIG. 10 is a view of the guard structure of the mandrel taken along line 10—10 of FIG. 1.

FIGS. 11 and 12 are opposite end views of the guard structure of FIG. 10.

FIG. 13 is a partial sectional view of a gas lift mandrel similar to that of FIG. 1 and illustrating the use of an orienting sleeve positioned in the upper portion thereof.

DETAILED DESCRIPTION OF PREFERRED EMBODIMENT

Figure 1:
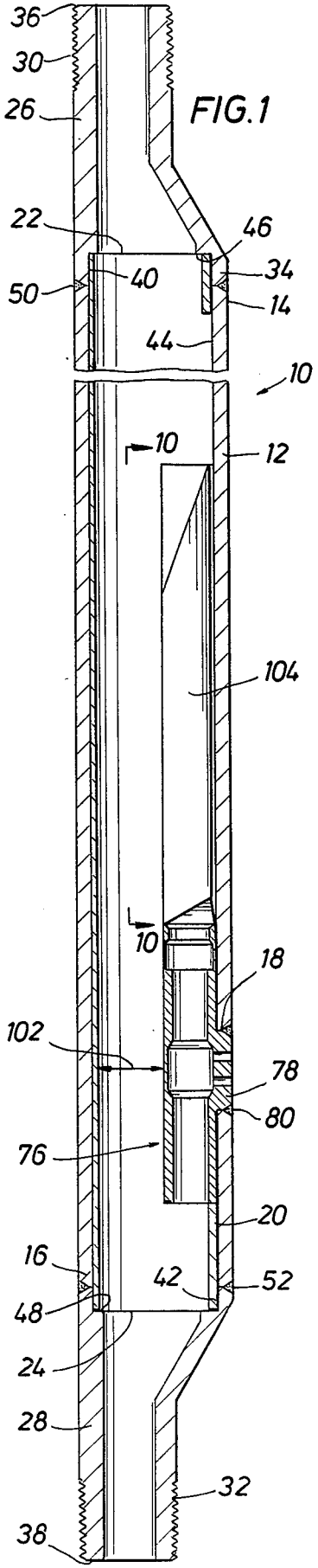
FIG. 1 is a sectional view of a gas lift mandrel constructed in accordance with the present invention.
Figure 2:
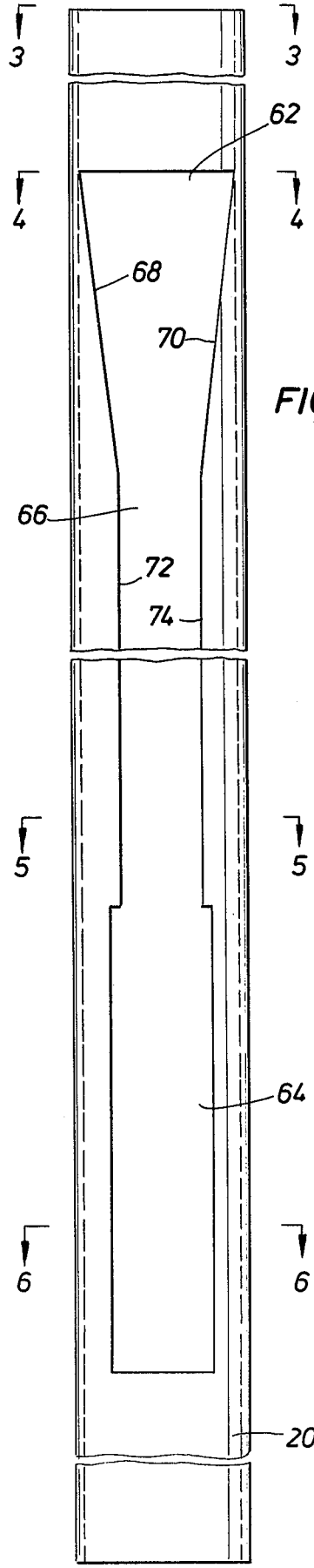
FIG. 2 is a side elevational view of the inner strengthening sleeve of the mandrel of FIG. 1, illustrating the configuration of the elongated opening which is formed therein.
Figure 3:
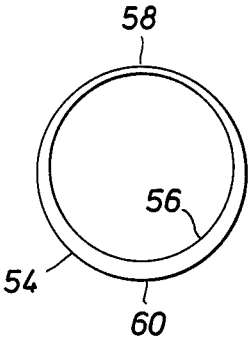
FIG. 3 is an end view of the sleeve structure of FIG. 2 taken along line 3—3 of FIG. 2.
Figure 4:
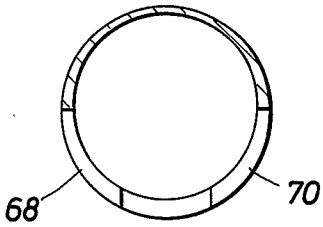
FIG. 4 is a transverse sectional view of the sleeve structure taken along line 4—4 of FIG. 2.
Figure 5:
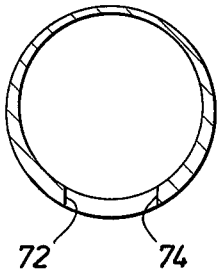
FIG. 5 is a transverse sectional view of the sleeve structure taken along line 5—5 of FIG. 2.
Figure 6:
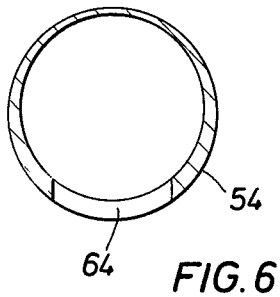
FIG. 6 is a transverse sectional view of the sleeve structure taken along line 6—6 of FIG. 2.

Referring now to the drawings and first to FIG. 1, a gas lift mandrel is illustrated generally at 10 which incorporates an elongated tubular body portion 12 having upper and lower extremities 14 and 16 which are prepared for welded connection to adjacent mandrel components. The elongated tubular body member 12 is formed to define a weld aperture 18 intermediate the extremities thereof.

Within the tubular body 12 is positioned an elongated tubular strengthening element 20 having upper and lower extremities 22 and 24 which extend beyond the respective upper and lower extremities 14 and 16 of the tubular body. The upper and lower extremities of the mandrel structure are respectively defined by swage connection members 26 and 28 having respective threaded portions 30 and 32 for threaded connection of the mandrel to adjacent sections of production tubing. If desired, the swage members 26 and 28 may be of substantially identical configuration. Each of the swage members define an offset inner extremity such as shown at 34 of swage 26 which defines an annular weld prepared surface that is capable of establishing mating relationship with the respective end surface 14 or 16 of the tubular body. The inner extremities of the swage members are offset in such manner that one portion of the wall surface thereof is disposed in coextensive relation with the upper and lower connection portions 36 and 38 while the opposite side wall structure projects outwardly for establishment of a mating relation with the larger diameter tubular body 12. The inner extremities of the swage members are therefore of larger diameter as compared to the connection extremities 36 and 38 thereof and are oriented in ecentric relation to the connection extremities.

During assembly of the tubular mandrel structure, the tubular strengthening sleeve element 20 is positioned within the tubular body 12 with the upper and lower extremities of the sleeve extending from the tubular body. The upper and lower swage members 26 and 28 are then positioned in assembly with the respective extremities of the tubular body in the manner shown in FIG. 1. The swage members each define annular pockets 40 and 42 which are oriented in coextensive relation with the inner wall surface 44 of the tubular body. The receptacles 40 and 42 define annular ecentric shoulders 46 and 48 which form abutment shoulders to restrict the tubular strengthening sleeve element 20 from linear movement. The upper and lower swage members are then joined to the tubular body by annular welds 50 and 52. These welds also penetrate into the tubular strengthening sleeve element 20 and thereby function to secure the sleeve in structural interrelation with the tubular body and with the upper and lower swage members.

As shown in FIGS. 2–6, the tubular strengthening sleeve element 20 is of elongated, generally cylindrical external form defining an outer generally cylindrical surface 54 having a dimension corresponding closely to the dimension of the annular surface 44 of the tubular body 12. The strengthening sleeve also defines an inner cylindrical surface 56 which is oriented in ecentric relation with respect to the outer surface 54, thereby providing the strengthening sleeve with a varying wall thickness having a minimum thickness at one side portion 58 thereof and a maximum wall thickness at the opposite side 60 thereof. The inner and outer surfaces 54 and 56 of the tubular strengthening sleeve are oriented such that the wall thickness varies gradually from the thin side portion 58 to the side portion 60 of maximum thickness.

Referring again to FIG. 2, the tubular strengthening sleeve element 20 is formed to define an elongated slot 62 having a lower generally rectangular slot portion 64 which is positioned in registry with the weld aperture 18 and with its upper and lower extremities located respectively above and below the weld aperture. The elongated slot 62 also includes an upper slot portion which receives a valve guard that is shown in FIG. 1 and more clearly identified in FIGS. 10–12. The upper slot portion 66 is formed to define a pair of downwardly converging surfaces 68 and 70 at the upper portion thereof and parallel guide surfaces 72 and 74 at the lower portion thereof.

Within the tubular body portion of the mandrel 10 is provided a gas lift valve receptacle structure shown generally at 76 and which is shown in greater detail in FIGS. 7–9. The receptacle structure 76 is formed to define an annular weld boss 78 which is positioned within the annular weld aperture 18. An annular weld 80 is then formed to secure the weld boss 78 to a tubular body 12, thereby securing the receptacle structure 76 in fixed relation within the mandrel. The weld boss 78 is generally defined by an annular enlargement formed intermediate the extremities of the valve receptacle structure 76. The inner portion of the weld boss is cut away as shown in FIGS. 8 and 9, thereby forming a flat surface 82. This cutaway portion of the annular weld boss simply provides clearance at the inner portion of the valve receptacle thereby ensuring that gas lift valves and wire line valve installation equipment is allowed to move past the receptacle structure during installation and removal. The valve receptacle also defines generally cylindrical upper and lower portions 84 and 86 which are positioned within the lower slot portion 64 of the tubular strengthening sleeve element 20. The upper portion of the valve receptacle 76 defines a thin cylindrical wall structure 88 which provides structural interconnection between the upper cylindrical portion 84 of the receptacle and a circular locking element 90. Within the thin cylindrical wall 88 is defined a locking receptacle 92 within which the latch portion of a gas lift valve is received to secure the valve in interlocked assembly with the gas lift valve receptacle. The receptacle also defines upper and lower generally cylindrical passages 94 and 96 within which upper and lower packing portions of a retrievable gas lift valve are positioned. The packings of the gas lift valve establish sealed relation with the passage portions 94 and 96. An enlarged passage portion 98 is defined between the passage portions 94 and 96 for registry with the gas inlet portion of the gas lift valve which is located between the packings. One or more apertures 100 are formed in the boss portion 78 of the valve receptacle to thus communicate gas from the well casing, through the valve receptacle and to the gas lift valve.

By positioning the valve receptacle 76 within the rectangular lower portion 64 of the slot of the strengthening sleeve element, the wall structure of the gas lift valve receptacle may be maintained at optimum thickness and the cylindrical upper and lower wall portions 84 and 86 may be brought into direct contact with the inner wall surface 44 of the tubular body. When this occurs, the gas lift valve passages 94 and 96 may be positioned as close as possible to the inner wall surface of the tubular body, thereby permitting maximum clearance between the inner surface portions of the gas lift valve receptacle and the inner surface of the tubular strengthening element 20 opposite the weld aperture. This clearance is shown at 102 in FIG. 1.

A valve guard structure is shown at 104 in FIG. 1 and is described in further detail in connection with FIGS. 10–12. The valve guard 104 functions to properly orient and guide a gas lift valve as it is brought into proper registry with the inner passage portions of the valve receptacle 76. The valve guard 104 includes a pair of spaced guard elements 106 and 108 which are located within the upper portion of the elongated slot 62 of the strengthening sleeve 20. The upper extremities of each of the guard elements 106 and 108 define tapered surface portions 110 and 112 respectively which converge downwardly and thereby provide an orienting and guiding function to properly orient the gas lift valve as it moves downwardly toward the passage portion of the receptacle. Conversely, the lower portions of the guard elements 106 and 108 define upwardly converging guide surfaces 114 and 116 which provide a guiding function as the gas lift valve is moved upwardly to thereby maintain the gas lift valve in properly oriented relation with respect to the elongated slot structure of the strengthening sleeve. The guard elements 106 and 108 are secured to the strengthening sleeve by welding to thus permit them to be fixed relative to the strengthening sleeve and to provide sufficient structural integrity for resistance of the valve orienting forces to which the guard elements are to be subjected.

As shown in FIGS. 3–6, the tubular strengthening element 20 is formed to define annular wall structure which varies from a minimum thickness at the portion opposite the elongated slot 62 to a maximum thickness at the wall portion within which the elongated slot is formed. By varying the wall thickness in this manner, the structural integrity of the tubular mandrel 10, and particularly the tubular body 12, is materially enhanced and yet the wall thickness of that portion of the sleeve lying opposite the valve receptacle and valve guard is minimized. This feature allows the clearance 102 to be sufficiently large that much larger gas lift valves may be passed through the clearance passage without any detrimental effects from the standpoint of structural integrity. In fact, without the provision of the additional strengthening effect of the inner strengthening sleeve in cooperating relation with the outer tubular body, the clearance passage past the valve guard and valve receptacle would be sufficient only for a small diameter valve, such as a one-inch valve for example. Through employment of an inner strengthening sleeve in conjunction with the outer tubular body, a larger valve, such as a one-and-one-half-inch valve for example, may be efficiently passed through the clearance passage. This feature allows the use of much larger valves in gas lift valves of small dimension and effectively permits gas lift valve designs to accommodate one-and-one-half-inch gas lift valves in well casing no larger than six inches. Obviously, the larger valves permit a significantly larger amount of gas to be injected into the production tubing and thereby permit more effective production from wells with small casing as compared to gas lift valve designs incorporating one-inch valves. Even though the gas lift mandrel of the present invention permits the passage of larger gas lift valves, such as one-and-one-half-inch valves for example, the pressure rating characteristics of the mandrel construction will remain within an optimum range for efficient trouble-free service for extended periods of time. The gas lift mandrel of this invention effectively permits utilization of retrievable gas lift valves of one-and-one-half-inch size under circumstances where heretofore, gas lift mandrels of fixed valve design were required for large valve, high gas volume induced production from wells having small diameter well casing.

FIG. 13 represents the upper portion of a gas lift mandrel similar to that of FIG. 1 and wherein an orienting sleeve 118 is retained within the upper swage portion 120 of the mandrel. The orienting sleeve 118 defines a tapered lower extremity 122 and an elongated slot 124. After the gas lift valve and wire line tool has passed the orienting sleeve, the wire line tool is then moved upwardly. An orienting portion of the tool engages the tapered cam surface portion 122 of the sleeve to thus cause rotation of the tool until the tool orienting element is received by the guide slot 124. Further upward movement of the wire line tool thus properly orients the gas lift valve for guided reception relative to the guide surfaces of the valve guard and thus permits the gas lift valve to be properly guided into received relation within the valve receptacle 76. When the orienting sleeve 118 is employed, the upper portion of the tubular sleeve is formed to define opposed tapered guide surfaces such as shown at 126. These guide surfaces further induce guiding control of the valve and wire line equipment as it moves downwardly toward the valve guard 104.

The foregoing disclosure and description of the invention are illustrative and explanatory thereof, and various changes in the size, shape and materials as well as in the details of the illustrated construction may be made without departing from the spirit of the invention.

What is claimed is:

1. A gas lift mandrel for installation in a string of production tubing extending into a well casing for production of petroleum products; said mandrel comprising:

(a) tubular body means having end portions adapted for connection to tubing sections making up said tubing string, said tubular body means defining a weld aperture in the side wall thereof;

(b) inner tubular sleeve means being secured within said tubular body means, said inner sleeve means defining elongated opening means in the wall structure thereof, said elongated opening means being of greater length as compared to the length of said weld aperture of said tubular body means; and (c) valve receptacle means being positioned within said tubular body and said inner tubular sleeve and adapted to receive a gas lift valve mechanism in locked relation therewith, said valve receptacle means defining a weld boss at one side thereof extending through said elongated opening means and being positioned within said weld aperture and secured to said tubular body means at said well aperture by welding, said weld boss defining gas aperture means communicating said valve receptacle means with the well casing.

2. A gas lift mandrel as recited in claim 1; wherein:

said tubular body means includes upper and lower end portions prepared for connection to sections of production tubing and an intermediate body portion of larger dimension than said end portions, said intermediate body portion being offset relative to said end portions.

3. A gas lift mandrel as recited in claim 2, wherein:

said end portions are of cylindrical tubular configuration and are oriented relative to said intermediate body portion such that side wall portions thereof are in colinear relation with each other and with a side wall portion of said intermediate body portion.

4. A gas lift mandrel as recited in claim 1, wherein:

(a) said elongated opening of said inner sleeve forms a valve receptacle portion; and (b) an elongated side portion of said valve receptacle means extends through said valve receptacle portion of said elongated opening of said inner sleeve and is in engagement with the inner wall surface of said tubular body means.

5. A gas lift mandrel as recited in claim 4, wherein:

(a) said elongated opening of said inner sleeve means also defines a valve guard portion; and (b) an elongated valve guard element is positioned within said valve guard portion of said inner sleeve means and is in contact with the inner wall of said tubular body means.

6. A gas lift mandrel as recited in claim 1, wherein: said inner sleeve means defines wall structure having greater thickness on the side having said weld aperture as compared to the side opposite said weld aperture.

7. A gas lift mandrel is recited in claim 6, wherein: said inner sleeve means defines inner and outer cylindrical surfaces oriented in ecentric relation and defines a wall thickness varying from a minimum thickness at said side opposite said weld aperture to a maximum thickness at said side having said weld aperture.

* * * * *